US008042213B2

(12) United States Patent
Yamane et al.

(10) Patent No.: US 8,042,213 B2
(45) Date of Patent: Oct. 25, 2011

(54) DEVICE AND METHOD FOR PREVENTING RUSTING OF CABLE FOR SUPPORTING BRIDGE

(75) Inventors: Mitsuhiro Yamane, Tokyo (JP); Manabu Inoue, Tokyo (JP); Nayomon Uno, Tokyo (JP)

(73) Assignee: IHI Infrastructure Systems Co., Ltd., Sakai-shi (JP)

( * ) Notice: Subject to any disclaimer, the term of this patent is extended or adjusted under 35 U.S.C. 154(b) by 0 days.

(21) Appl. No.: 12/739,981

(22) PCT Filed: Jul. 14, 2008

(86) PCT No.: PCT/JP2008/062673

§ 371 (c)(1),
(2), (4) Date: Aug. 2, 2010

(87) PCT Pub. No.: WO2009/057356

PCT Pub. Date: May 7, 2009

(65) Prior Publication Data

US 2010/0293728 A1 Nov. 25, 2010

(30) Foreign Application Priority Data

Oct. 30, 2007 (JP) ..... 2007-282152

(51) Int. Cl.
*E01D 19/16* (2006.01)

(52) U.S. Cl. ..... 14/18; 14/22; 14/23

(58) Field of Classification Search ..... None
See application file for complete search history.

(56) References Cited

U.S. PATENT DOCUMENTS 7,814,600 B2 * 10/2010 Bournand ..... 14/22

FOREIGN PATENT DOCUMENTS

| | | | |
|---|---|---|---|
| DE | EP 0350822 | * | 7/1989 |
| JP | 8 177012 | | 7/1996 |
| JP | 10 159019 | | 6/1998 |
| JP | 2000 328474 | | 11/2000 |

* cited by examiner

*Primary Examiner* — Raymond Addie
(74) *Attorney, Agent, or Firm* — Oblon, Spivak, McClelland, Maier & Neustadt, L.L.P.

(57) ABSTRACT

A suspension bridge is supported by a cable having one or more cable bands. An anti-rusting device is comprised of one or more covers, each of the covers including an inner peripheral surface and covering the cable so as to leave a gap between the inner peripheral surface and an outer periphery of the cable, the gap being capable of conveying a gas along the outer periphery of the cable; and a ventilator configured to dry and feed the gas into the gap, the ventilator air-tightly communicating with the gap.

9 Claims, 5 Drawing Sheets

(a)

(b)

DEVICE AND METHOD FOR PREVENTING RUSTING OF CABLE FOR SUPPORTING BRIDGE

TECHNICAL FIELD

The present invention relates to a device and a method for preventing rusting of cables for supporting bridges, such as main cables of suspension bridges or cables of cable-stayed bridges.

BACKGROUND ART

As types of bridges in which cables made of steel or such support girders, suspension bridges and cable-stayed bridges are widely known. In a suspension bridge, hanger ropes are vertically hung down at intervals from a main cable that spans bridge towers and then the hanger ropes support a girder of the bridge.

Suspension bridges are advantageous in embodying bridges of great length. Thus many bridges of great length crossing over straights or great rivers are constructed as suspension bridges. To bear great weight of very long girders, a number of steel wires are densely bundled together to form a strand and a number of such strands are further bundled together to form a main cable thereof in general. In between adjacent strands, and further in between adjacent steel wires, a great number of very narrow gaps exist. If rainwater intrudes into these narrow gaps, the rainwater accumulates over a long duration and therefore causes corrosion of the cable. A main cable, after once being laid, is actually irreplaceable and therefore degradation by corrosion is a very significant problem. More specifically, in regard to a lifetime of a bridge of great length, prevention of rusting of its cable is an important technical problem.

Japanese Patent Application Laid-open No. H08-177012 discloses an art for preventing rusting of a main cable, in which strands are respectively enclosed in seal pipes respectively ventilated with dried air.

DISCLOSURE OF INVENTION

The present invention is intended for providing a device and a method capable of preventing rusting of a cable by keeping the cable in a dried state even with a simpler structure.

According to a first aspect of the present invention, an anti-rusting device applied to a cable for supporting a bridge, which has one or more cable bands, is comprised of one or more covers, each of the covers including an inner peripheral surface and covering the cable so as to leave a gap between the inner peripheral surface and an outer periphery of the cable, the gap being capable of conveying a gas along the outer periphery of the cable; and a ventilator configured to dry and feed the gas into the gap, the ventilator air-tightly communicating with the gap.

Preferably, the cover is comprised of a first member and a second member mutually air-tightly joined along the longitudinal direction, and one or more selected from the group consisting of the first member and the second member maintain the gap in the full length along the longitudinal direction.

Preferably, the cover is comprised of a rib projecting outward and stretching in the full length along the longitudinal direction of the cover so as to establish a flow passage.

Preferably, the anti-rusting device is further comprised of a wire being in close contact with and spirally wound around the outer periphery of the cable and being in contact with the inner peripheral surface of the cover.

Preferably, the anti-rusting device is further comprised of one or more bypass tubes linking ones of the covers together so as to convey the gas, the ones being adjacent across the cable bands.

According to a second aspect of the present invention, a bridge is comprised of any of the aforementioned anti-rusting devices.

According to a third aspect of the present invention, an anti-rusting method applied to a cable for supporting a bridge, which has a longitudinal direction, is comprised of covering an outer periphery of the cable so as to leave a gap, the gap being capable of conveying a gas along the outer periphery of the cable; and feeding the gas being dried into the gap.

BEST MODE FOR CARRYING OUT THE INVENTION

Certain embodiments of the present invention will be described hereinafter with reference to the appended drawings.

Figure 1:
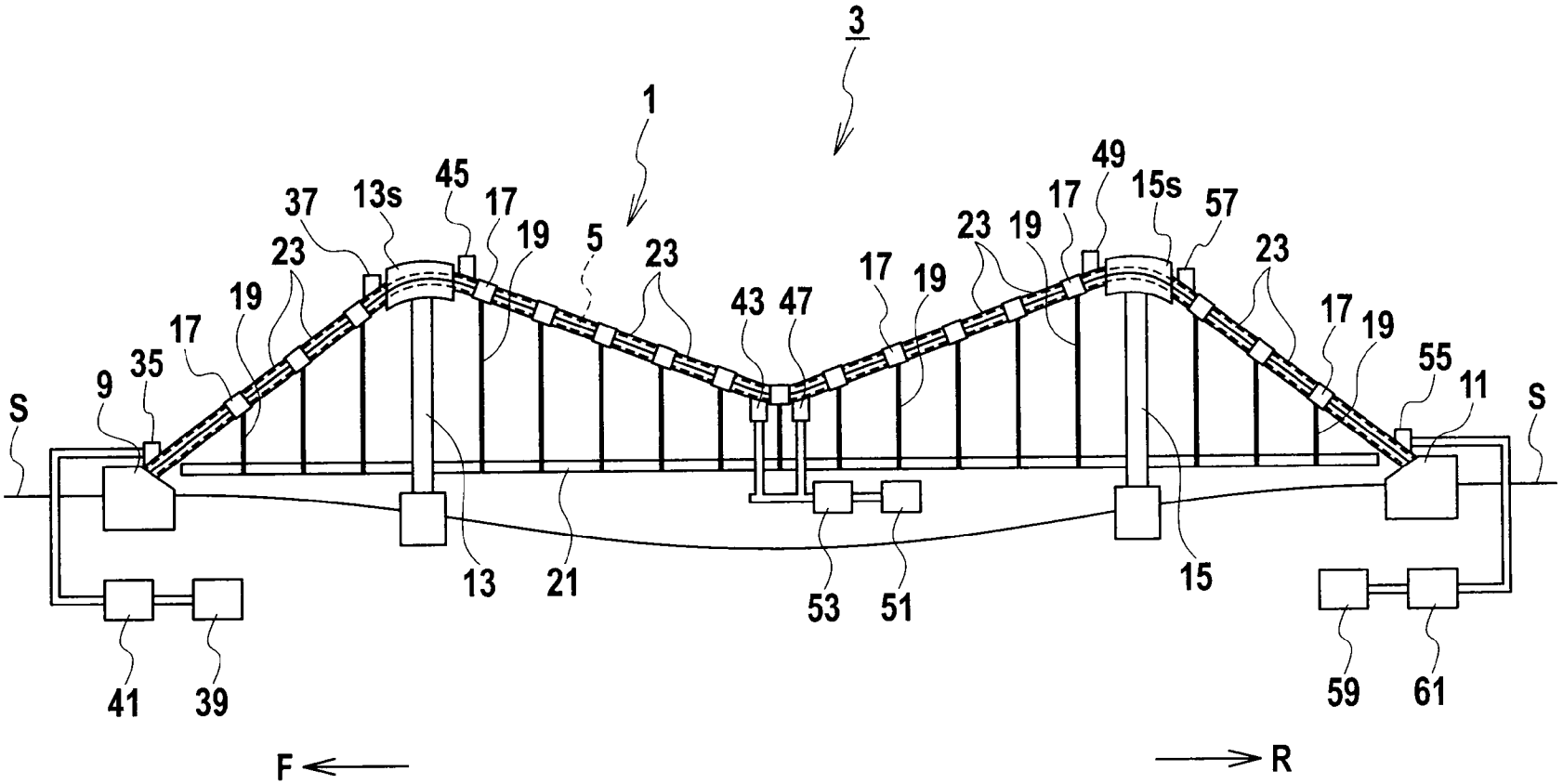
FIG. 1 is a schematic drawing of a suspension bridge.

Throughout the specification and claims, the term "dense" is defined and used as a state of direct contact excluding any intervening member except any liquid or any viscous fluid such as an antirust paste. Further, with respect to directions of a bridge and respective members thereof, the following descriptions are given on the basis of an assumption in that a direction toward the left in FIG. 1 is defined as a forward direction and a direction toward the right is defined as a rearward direction for convenience of explanation. Of course, directions are not limited thereto. In FIG. 1, the forward and rearward directions are indicated by references F and R, respectively.

A bridge 3, to which an anti-rusting device 1 in accordance with an embodiment is applied, is comprised of a main cable 5 spanning a front bridge abutment 9 and a rear bridge abutment 11 respectively fixed on both banks S, a plurality of cable bands 17 fixed on the main cable 5 at intervals, hanger ropes 19 respectively hung down from the cable bands 17, and a girder 21 supported by the hanger ropes 19. The main cable 5 is laid on a front bridge tower 13 and a rear bridge tower 15 with having tower-top saddles 13*s*, 15*s* interposed. With respect to the main cable 5, as publicly known, a number of wires 7 are densely bundled together or a number of strands, in each of which a number of wires 7 are densely bundled together to form the strand, are further densely bundled together to form the main cable 5.

At intervals between the cable bands 17, covers 23 respectively cover the main cable 5. Ordinarily drying devices 39, 59 and ventilators 41, 61 are respectively installed on both banks S and communicate with the interiors of the covers 23 via intake ports 35, 55. Also at a midway of the bridge, around a lowermost point of the main cable 5 between the bridge towers 13, 15, a drying device 51 and a ventilator 53 are installed and communicate with the interiors of the covers 23 via intake ports 43, 47. Near the tower-top saddles 13*s*, 15*s*, exhaust ports 37, 45, 49, 57 are provided.

The positions of the ventilators 51, 53 are not limited to the aforementioned sites and may be installed near the tower-top saddles 13*s*, 15*s* for instance. In this case, exhaust ports, instead of the intake ports 35, 55, may be installed on both banks S.

Figure 2:
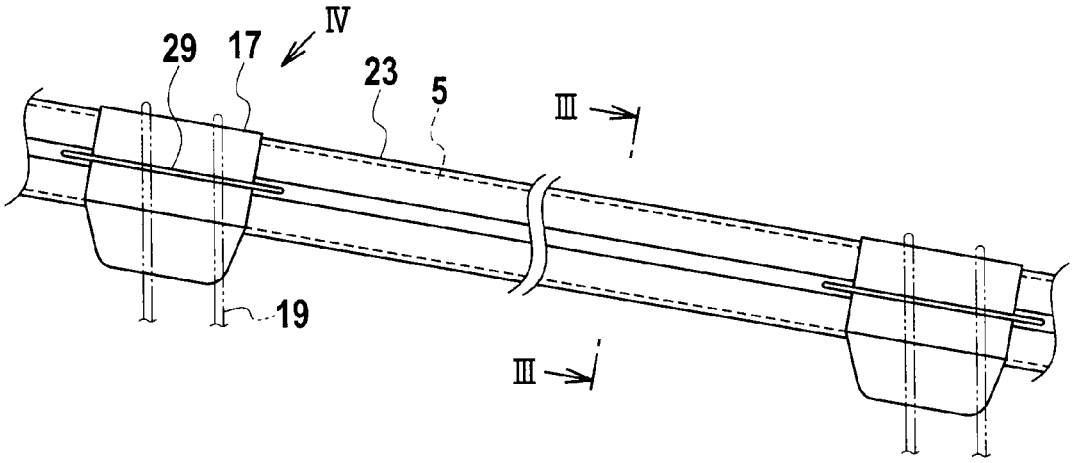
FIG. 2 is a drawing showing an anti-rusting device in accordance with a first embodiment of the present invention, in which: (a) illustrates a state in that a cable cover is being mounted; and (b) illustrates a state in that the cable cover is being removed.
Figure 2:
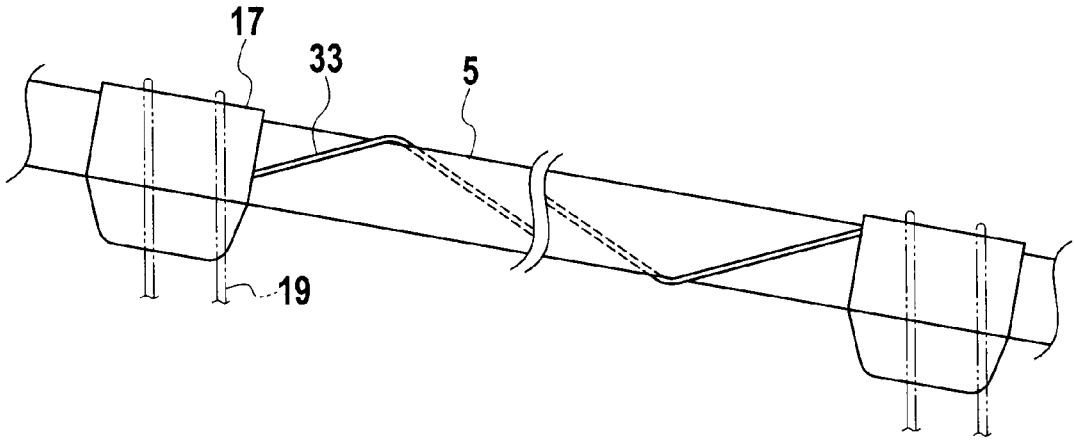
Figure 3:
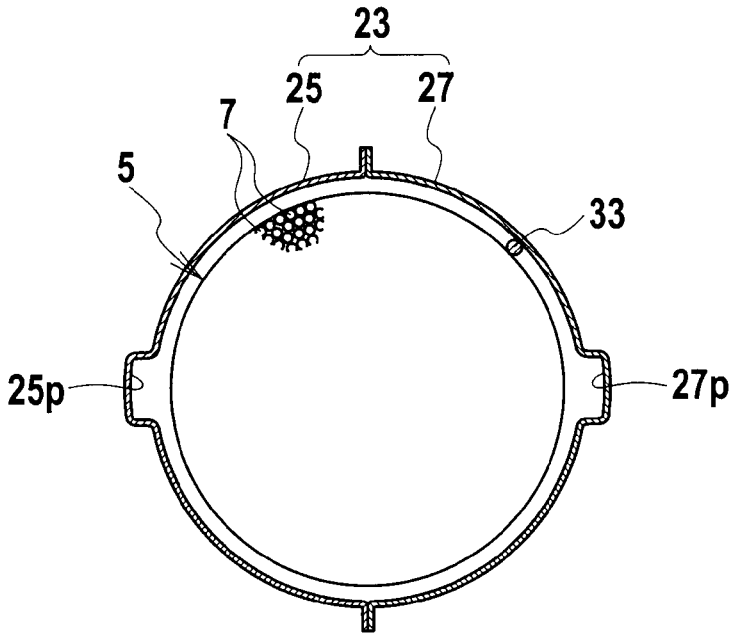
FIG. 3 is a cross sectional view of the anti-rusting device taken from a line III-III of FIG. 2.

Referring to FIG. 2(*a*), each cover 23 covers an outer periphery of the main cable 5 and a gap is, as shown in FIG. 3, left between an inner peripheral surface of the cover 23 and the outer periphery of the main cable 5. The gap is capable of conveying a gas along the outer periphery of the main cable 5 in its longitudinal direction. The cable bands and the covers 23 are mutually joined in an air-tight manner and thus the gap is kept air-tight relative to the exterior.

Figure 4:
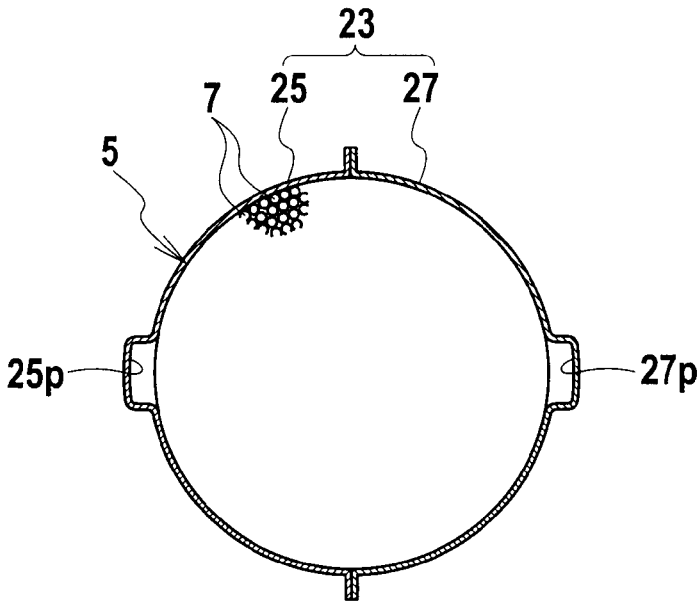
FIG. 4 is a cross sectional view of the anti-rusting device in which a wire spirally winding around a cable is omitted.

As shown in FIG. 2(*b*), a wire 33 may be in advance made close contact with and wound in a spiral shape around the outer periphery of the main cable 5. The wire 33 in close contact and spirally wound around the main cable 5 abuts on the inner peripheral surface of the cover 23 and is of advantage to maintaining the gap. The wire 33 is made of steel or such and is preferably, but not limited to be, galvanized. Alternatively, as shown in FIG. 4, the wire 33 may be omitted so as to allow the cover 23 to be in contact with the main cable 5.

Each cover 23 is comprised of a first cover member 25 and a second cover member 27, both of which are formed in a half cylindrical shape. The members 25 and 27 are air-tightly joined together so as to have the main cable 5 put therebetween, thereby exhibiting a cylindrical outline in general. The first cover member 25 is comprised of a rib that projects outward and stretches in the full length along the longitudinal direction thereof, and thus a first flow passage 25*p* is established between an inner peripheral surface of the rib and the outer periphery of the main cable 5. The second cover member 27 is similarly comprised of a rib, thereby establishing a second flow passage 27*p* between an inner peripheral surface of the rib and the outer periphery of the main cable 5. The flow passages 25*p*, 27*p* constitute a part of the aforementioned gap and also function as flow passages of greater width than the other part of the gap. The rib may be possessed only by one of the first cover member 25 and the second cover member 27.

Figure 6:
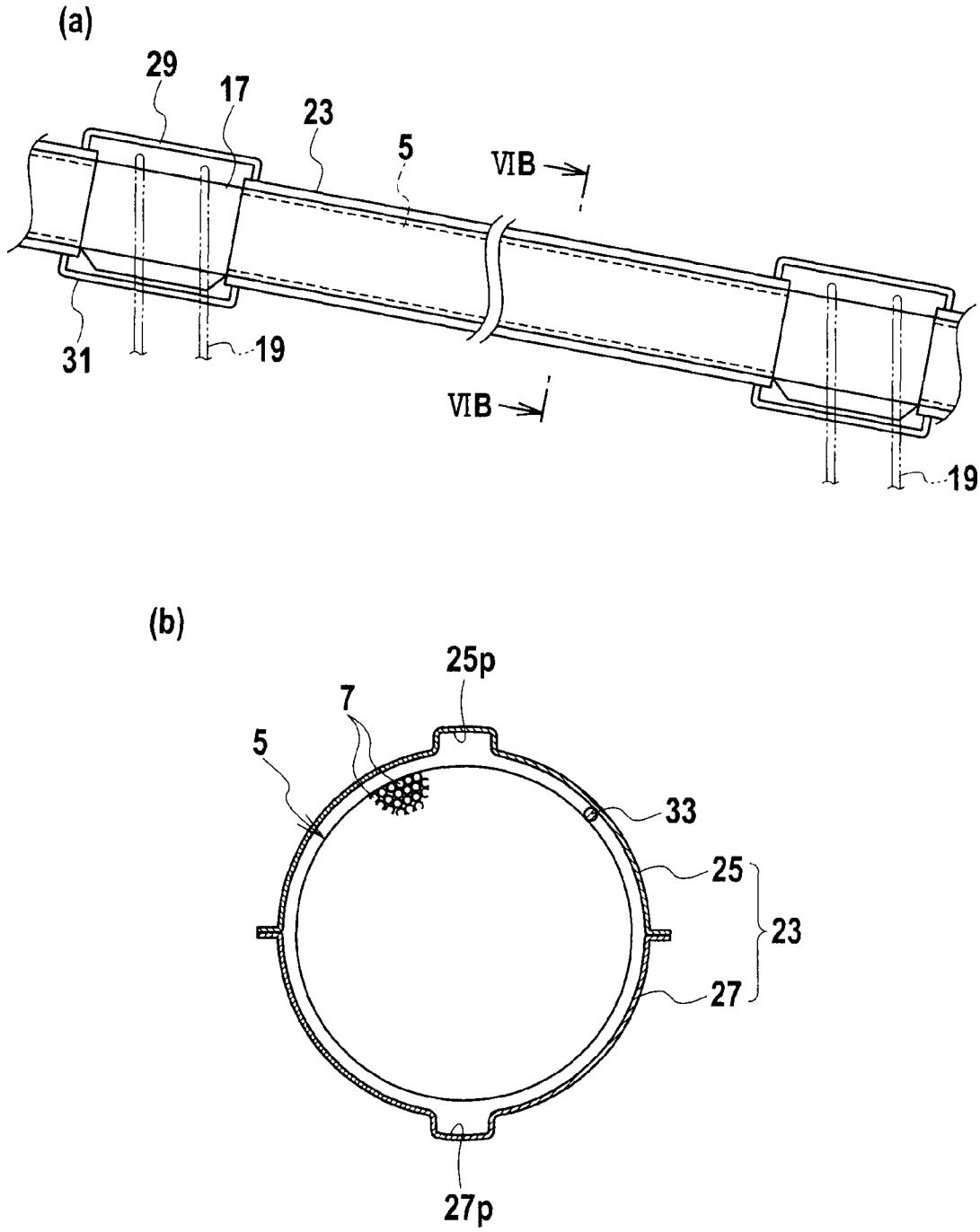
FIG. 6 is a drawing showing an anti-rusting device of a modified embodiment, in which: (a) illustrates a state in that a cable cover is being mounted; and (b) shows a cross sectional view taken from a line VIB-VIB of (a).

The first flow passage 25*p* and the second flow passage 27*p* may be, but not limited to, symmetrical. Alternatively, as shown in FIGS. 2(*a*) and 3, the first flow passage 25*p* and the second flow passage 27*p* may be oriented to have no incline relative to a horizontal direction with respect to its axial center, or, as shown in FIGS. 6(*a*),(*b*), oriented to align together in a perpendicular direction with respect to its axial center. Further, as being in an intermediate manner between these orientations, they may be oriented in an inclined direction.

The gap is maintained in the full length along the longitudinal direction of the cover 23. Any one, or both, of the first cover member 25 and the second cover member 27 supports the gap.

Figure 5:
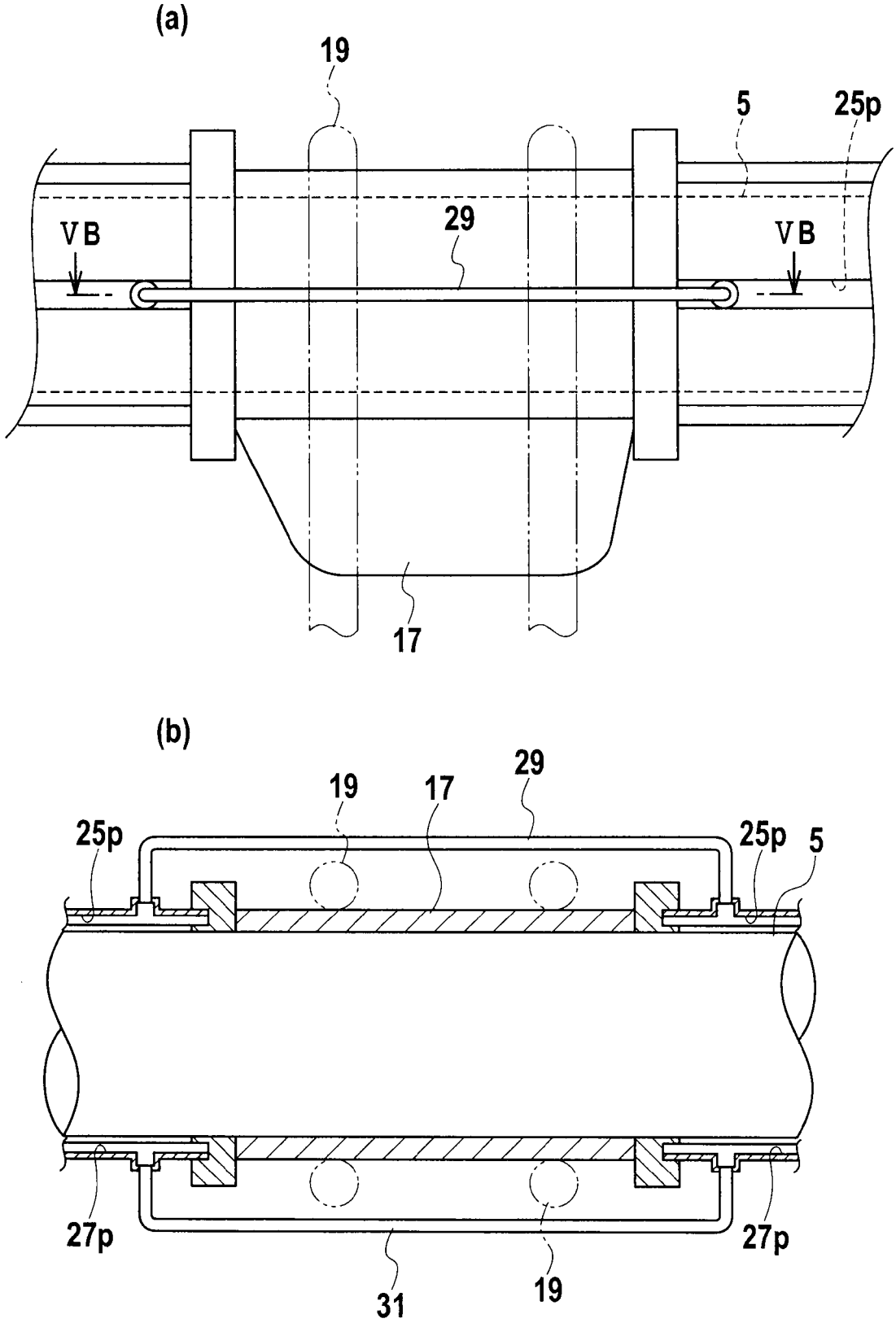
FIG. 5 shows the anti-rusting device viewed from an arrow V of FIG. 2.

Referring to FIGS. 5(*a*),(*b*), bypass tubes 29 and 31 are provided on each cable band 17 and link covers 23 that are adjacent across the cable bands so as to allow gas passage therebetween. The first bypass tube 29 links two adjacent first flow passages 25*p* and the second bypass tube 31 links two adjacent second flow passages 27*p*. Any one, or both, of the first bypass tube 29 and the second bypass tube 31 may have a valve for switching ON and OFF the gas passage.

A cover 23 provided at the front end, namely adjacent to the front bridge abutment 9, lacks bypass tubes 29,31 at its very end adjacent to the front bridge abutment 9, but is instead comprised of an intake port 35 to air-tightly communicate with the drying device 39 and the ventilator 41. Further, a cover 23 provided at an end adjacent to the saddle 13*s* of the front bridge tower 13 is comprised of an exhaust port 37. More specifically, the drying device 39, the ventilator 41, the cover 23 and the bypass tubes 29,31 are made to mutually communicate in such a way that dried air generated by the drying device 39 is introduced through the inlet port 35 into the cover 23 at the end, goes through the plurality of bypass tubes 29, 31 and the covers 23, and is then exhausted from the exhaust port 37 at the tower top.

The same applies to the rear end of the suspension bridge 3. A cover 23 at the end is comprised of an intake port 55 and thereby air-tightly communicates with the drying device 39 and the ventilator 41. Further, a cover 23 at an end adjacent to the saddle 15*s* of the rear bridge tower 15 is comprised of an exhaust port 57. The drying device 59, the ventilator 61, the cover 23 and the bypass tubes 29,31 are made to mutually communicate in such a way that dried air generated by the drying device 59 is introduced through the inlet port 55 into the cover 23 at the end, goes through the plurality of bypass tubes 29, 31 and the covers 23, and is then exhausted from the exhaust port 57 at the tower top.

Arrangement of the exhaust ports is not limited to that described above. For example, instead of, or in addition to, any or both of the exhaust ports 37,45, an exhaust port may be provided at the tower-top saddle 13*s*. More specifically, one or more exhaust ports can be provided around the tower-top saddle 13*s*. Similar modifications may be applied to the tower-top saddle 15*s*.

Covers 23 at both sides of a cable band 17 around a lowermost point among the cable bands 17 of the main cable 5 are respectively comprised of inlet ports 43,47 and communicate with the drying device 51 and the ventilator 53. Covers 23 at the ends adjacent to the tower-top saddles 13*s*,15*s* are respectively comprised of exhaust ports 45,49. More specifically, the drying device 51, the ventilator 53, the cover 23 and the bypass tubes 29,31 are made to mutually communicate in such a way that dried air generated by the drying device 51, on one hand, goes from the inlet port 43 through the plurality of covers 23 and the plurality of bypass tubes 29, 31 and is then exhausted from the exhaust port 45 at the tower top, and, on the other hand, goes from the inlet port 47 through the plurality of covers 23 and the plurality of bypass tubes 29, 31 and is then exhausted from the exhaust port 49 at the tower top.

The respective exhaust ports 37, 45, 49, 57 may be comprised of flow rate measurement devices for measuring flow rate of the air exhausted therefrom. The respective drying devices and the respective ventilators can be controlled to regulate feeding rate of air, or to intermittently feed air, in response to the measured flow rate. Alternatively as being non-responsive to the measured flow rate, they can be controlled to give slightly positive pressure relative to the atmospheric pressure to the interiors of the covers 23.

As being understood from the above description, as dried air steadily flows around the main cable 5, the main cable 5 is kept in a dried state. Therefore, without any anti-rusting means such as an antirust paste, the main cable 5 is prevented from rusting for a long duration. Regardless of whether an antirust paste already given is removed or left, the aforementioned anti-rusting device 1 can be applied to any bridges already constructed. As flow passageways are established by means of bypass tubes respectively making detours over cable bands, construction thereof does not require detachment of the cable bands.

As compared with a case in which sealing pipes are respectively given to strands to feed dried air, it is not required to stand force bringing strands mutually closer to maintain a gap around a cable. Therefore the aforementioned device and method realize anti-rusting of cable although its structure is relatively simple.

In the above description, a main cable of a suspension bridge is taken as an example, however, the aforementioned anti-rusting device and the anti-rusting method may be applied to cables of a cable-stayed bridge or any construction that requires suspension by cables. Meanwhile, instead of dried air, non-corrosive gas such as dried nitrogen may be fed.

Although the invention has been described above by reference to certain embodiments of the invention, the invention is not limited to the embodiments described above. Modifications and variations of the embodiments described above will occur to those skilled in the art, in light of the above teachings.

INDUSTRIAL APPLICABILITY

A device and a method capable of preventing rusting of a cable by keeping the cable in a dried state even with a simpler structure are provided.

The invention claimed is:

1. An anti-rusting device applied to a cable to support a bridge having one or more cable bands and a longitudinal direction, the device comprising:

at least one cover, each of the covers including an inner peripheral surface and covering the cable so as to leave a gap between the inner peripheral surface and an outer periphery of the cable, the gap configured to convey a gas along the outer periphery of the cable; and a ventilator configured to dry and feed the gas into the gap to dry the cable, the ventilator air-tightly communicating with the gap, wherein each of the covers includes a rib projecting outward and stretching along a full length of the longitudinal direction of the cover so as to establish a flow passage.

2. The anti-rusting device of claim 1, wherein each of the covers includes a first member and a second member mutually air-tightly joined along the longitudinal direction, and at least one of the first member and the second member maintain the gap along a full length of the longitudinal direction.

3. The anti-rusting device of claim 1, further comprising:

a wire in contact with and spirally wound around the outer periphery of the cable and in contact with the inner peripheral surface of the cover.

4. The anti-rusting device of claim 1, further comprising:

at least one bypass tube linking the covers together so as to convey the gas, the covers being adjacent across the cable bands.

5. A bridge comprising the anti-rusting device of claim 1.

6. The anti-rusting device of claim 1, wherein each of the first member and the second member has a half-cylindrical shape.

7. The anti-rusting device of claim 2, wherein only one of the first member and the second member includes the rib projecting outward and stretching along a full length of the longitudinal direction of the cover so as to establish a flow passage.

8. The anti-rusting device of claim 2, wherein each of the first member and the second member includes the rib projecting outward and stretching along a full length of the longitudinal direction of the cover so as to establish a flow passage.

9. The anti-rusting device of claim 8, wherein the rib of the first member is symmetrical with the rib of the second member around the inner peripheral surface.

* * * * *